US007954537B2

(12) United States Patent
Kraeutler

(10) Patent No.: US 7,954,537 B2
(45) Date of Patent: Jun. 7, 2011

(54) FOLDING DOOR AND SHUTTER GUIDE DEVICE

(75) Inventor: Bernard Kraeutler, Dunieres (FR)

(73) Assignee: Nergeco (FR)

( * ) Notice: Subject to any disclaimer, the term of this patent is extended or adjusted under 35 U.S.C. 154(b) by 0 days.

(21) Appl. No.: 10/564,604

(22) PCT Filed: Jul. 12, 2004

(86) PCT No.: PCT/FR2004/001832

§ 371 (c)(1),
(2), (4) Date: Sep. 18, 2006

(87) PCT Pub. No.: WO2005/008014

PCT Pub. Date: Jan. 27, 2005

(65) Prior Publication Data

US 2007/0006978 A1 Jan. 11, 2007

(30) Foreign Application Priority Data

Jul. 15, 2003 (FR) ..... 03 08619

(51) Int. Cl.
*E06B 3/94* (2006.01)

(52) U.S. Cl. ..... 160/84.06; 160/264; 160/273.1

(58) Field of Classification Search ..... 160/84.06, 160/264, 121.1, 270, 271, 272, 273.1, 201, 160/207, 243, 133, 172 R
See application file for complete search history.

(56) References Cited

U.S. PATENT DOCUMENTS

| | | | | | |
|---|---|---|---|---|---|
| 1,549,714 | A | * | 8/1925 | Bretos y Clavería | 160/23.1 |
| 2,041,410 | A | * | 5/1936 | Goodman | 160/207 |
| 3,344,837 | A | * | 10/1967 | Young | 160/189 |
| 3,552,474 | A | * | 1/1971 | Finnegan | 160/201 |
| 3,894,571 | A | * | 7/1975 | Hinchliff | 160/201 |
| 4,194,549 | A | * | 3/1980 | Lovgren | 160/84.02 |
| 4,363,348 | A | * | 12/1982 | Heikki | 160/84.02 |
| 4,397,347 | A | * | 8/1983 | Brabant | 160/231.2 |
| 4,938,273 | A | * | 7/1990 | Dubbelman et al. | 160/201 |
| 5,056,579 | A | * | 10/1991 | Krafutler | 160/271 |
| 5,141,043 | A | * | 8/1992 | Kraeutler | 160/264 |
| 5,219,015 | A | * | 6/1993 | Kraeutler | 160/271 |
| 5,394,926 | A | | 3/1995 | Kraeutler | |
| 5,765,622 | A | * | 6/1998 | Lichy | 160/273.1 |
| 6,035,918 | A | * | 3/2000 | Kraeutler | 160/84.06 |
| 6,152,207 | A | * | 11/2000 | Varley | 160/264 |
| 6,155,326 | A | * | 12/2000 | Imhoff et al. | 160/243 |
| 6,374,567 | B1 | | 4/2002 | Mullet | |
| 6,397,916 | B1 | * | 6/2002 | Bengtsson et al. | 160/84.06 |

* cited by examiner

*Primary Examiner* — David Purol
(74) *Attorney, Agent, or Firm* — Cantor Colburn LLP

(57) ABSTRACT

The invention relates to a folding door and a shutter guide device. The inventive door comprises two vertical slides (2) and at least one flexible shutter (4) which can be folded in the upper part of the slides and which comprises at least one transverse stiffening bar (12). According to the invention, a guide device (14) is inserted into the extension of at least one stiffening bar (12), thereby forming a guide for the shutter (4) in at least one of the slides (2) in a plane that is offset in relation to the plane of the shutter (4), said shutter (4) being applied against a surface of the slide (2).

16 Claims, 5 Drawing Sheets

FOLDING DOOR AND SHUTTER GUIDE DEVICE

TECHNICAL FIELD OF THE INVENTION

The present invention relates to a door with a flexible folding shutter and a device for guiding the door shutter.

BRIEF DESCRIPTION OF RELATED ART

In the field of flexible shutter doors, there are doors called roller doors in which a flexible shutter rolls up on a shaft and doors called folding doors in which, when the shutter is opened, the latter folds concertina-like at the top of the door.

The doors of the latter type have, schematically, two vertical slides at the top of which is placed an electric motor-driven shaft. The shutter is suspended on a transverse bar situated below the roller shaft and has at its bottom end a sill bar. Two vertical and parallel straps attached, first, to the sill bar and, secondly, to the roller bar make it possible to raise the shutter when the shaft is set in rotation.

The shutter in its raised position is amassed concertina-like in the top portion of the door and opens the passage.

Usually, the shutter is provided with several sheaths in which stiffening bars are inserted.

A major problem that is posed for these doors is that of managing the seal between the lateral edges of the shutter and the vertical uprights.

Specifically, to receive the shutter in the top position, the slides usually have a C-shaped cross section whose two flanges are 300 to 600 mm apart. This distance makes it possible to receive, between the two flanges of the upright, the concertina-like folds of the shutter when it is raised.

The consequence of the large opening of the uprights is that, when the wind blows, the shutter tends to rattle and an exchange of air is generated via the lateral edges of the latter.

BRIEF SUMMARY OF THE INVENTION

The invention aims to remedy these disadvantages and its object is to improve the seal of a folding door.

For this purpose, the subject of the invention is a door comprising, in a manner known per se, two vertical slides and at least one flexible shutter capable of being folded in the upper part of the slides, having at least one transverse stiffening bar.

According to the invention, a guide device is engaged in the extension of at least one stiffening bar producing a shutter guide in at least one of the slides in a plane offset relative to the plane of the shutter, the shutter being pressed against a surface of the slide.

Thus, the basic idea of the invention consists in providing a shutter guide to prevent the latter from rattling when it is exposed to gusts of wind, this guide being offset relative to the plane of the shutter to allow a surface pressure of the shutter on a surface of the slides. This pressure of the shutter against a surface of each slide prevents the generation of an exchange of air at the lateral edges of the shutter. This arrangement is totally noteworthy since it allows the shutter to be folded in the top part of the door and outside the slide, while retaining the seal.

According to an advantageous embodiment, the guide device has at least one guide member whose axis is offset relative to the plane of the shutter.

For the shutter to be folded harmoniously, the connection between the guide device and the stiffening bar allows the guide device to rotate relative to the stiffening bar.

To prevent an accidental action against the shutter from causing damage that is costly to repair thereon, at least one of the connections between the guide devices and, first, the stiffening bar and, secondly, the slide is capable of dislocating without an external action exceeding a predetermined value. Thus, before a permanent deformation of the stiffening bar or of the slide, the guide device breaks to prevent irreversible damage to the door. Preferably, the guide device (14) has at least one breakaway or deformation zone likely to disengage the guide device from the stiffening bar (12) or from the slide (2).

According to a possible embodiment of the door in which it comprises two parallel shutters, the latter comprises a guide device that can engage with a stiffener belonging to each of the shutters, having at least one guide member offset relative to the plane of each of the flexible shutters.

In this possible embodiment, a link strut connects two stiffening bars, which makes it possible to create an assembly of high inertia while having a limited mass.

Preferably, each of the slides has a first flange against the outer face of which the shutter presses and a second flange delimiting with the first flange a groove receiving a guide member of the guide device.

In addition, the shutter has a window at the end of each stiffening bar through which the guide device protrudes.

The invention also relates to a guide device that comprises a body having at one of its ends, at least one means of engagement with a stiffening bar, and, at its second end, at least one guide member whose axis is offset relative to the axis of the means of engagement with the stiffening bar.

There again, the basic idea of the invention re-emerges, since the guide device makes it possible to provide a shutter guide in a plane offset relative to the very plane of the shutter, which makes it possible to make a space allowing the latter to be pressed against a surface of a slide.

According to a possible embodiment, the guide device consists of a body having a large base and a small base that are parallel and connected by a semicylindrical wall perpendicular to the two bases, the large base being fitted with at least one guide member and the small base having a blind hole capable of receiving a stiffening bar.

Advantageously the guide members comprise:

- a ring having a semicylindrical wall placed in the extension of the semicylindrical wall and a flat wall, and
- a rotary roller.

The semicylindrical ring extends the stiffening bar and thus prevents folds from forming in the shutter of the shutter at the end of the latter.

Advantageously, the semicylindrical ring encloses a roller.

According to another possible embodiment, the guide members consist of two rollers oriented in a V-formation one relative to the other, capable of pressing against a rib having a V-section.

In the case of a door having two parallel shutters, the guide device comprises a body having a large base and two small bases symmetrical relative to the mid-plane, each of the bases being connected to the large base by a semicylindrical wall, the large base being fitted with at least one guide member and each of the small bases having a blind hole capable of receiving a stiffening bar.

In this case, according to one possibility, the guide members comprise

- a rotary roller, and
- two rings symmetrical relative to the rotary roller having a semicylindrical wall placed in the extension of the semicylindrical wall and a flat wall.

To be correctly understood, the invention is described with reference to the drawings here attached representing as non-limiting examples several embodiments of folding doors and of guide devices according to the latter.

DETAILED DESCRIPTION OF THE INVENTION"

For simplification purposes, the items that recur in these different embodiments or that are similar from one embodiment to another are identified by the same reference numbers.

Figure 1:
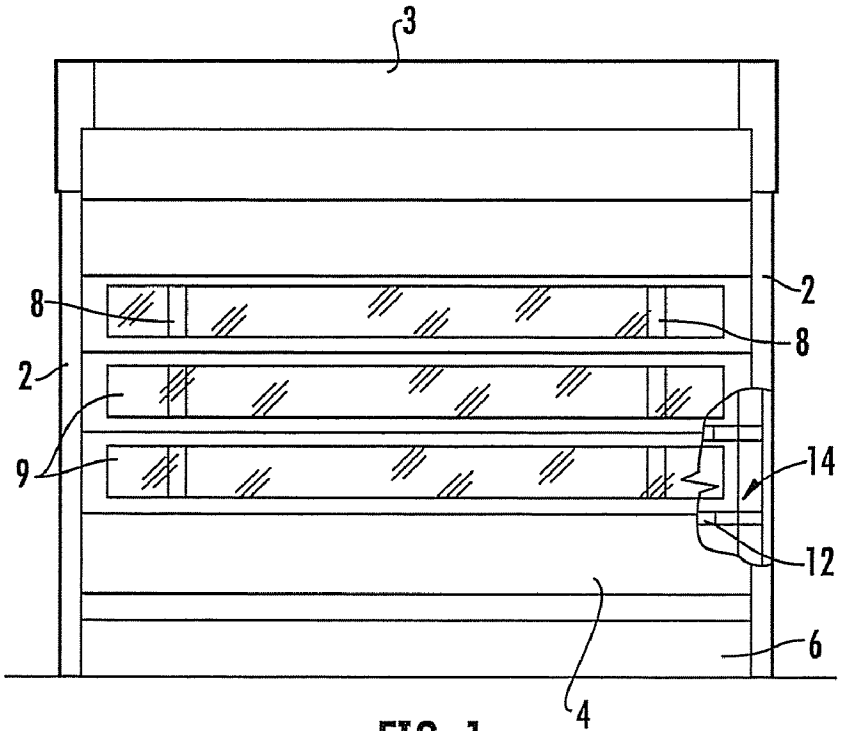
FIG. 1 represents a door seen from the outside with the shutter partially pulled away at the end of the stiffening bars.

With reference first of all to FIG. 1, it can be seen that the guide device according to the invention finds its application for a door comprising two lateral slides 2 supporting a roller shaft at their top end.

In FIG. 1, the roller shaft is hidden by a transverse cover 3.

A flexible shutter 4 is suspended between the two lateral slides 2 by a suspension bar. At its bottom end, the flexible shutter 4 is fitted with a sill bar 6 which is connected by straps 8 to the roller shaft situated in the casing 3. The straps 8 appear through transparent windows 9 made in the shutter 4.

In the following description, by convention the interior will be called the side of the door on which the straps are mounted and exterior will be the side of the door without straps as it appears in FIG. 1. This corresponds to the usual installation arrangement of these doors. It is however understood that the distinction between interior and exterior is simply to simplify the description of these doors but that the door may of course separate two rooms each situated in one and the same building.

Usually, the shutter 4 has, at regular intervals, sheaths extending across its whole width in which stiffening bars 12 are inserted.

Figure 2:
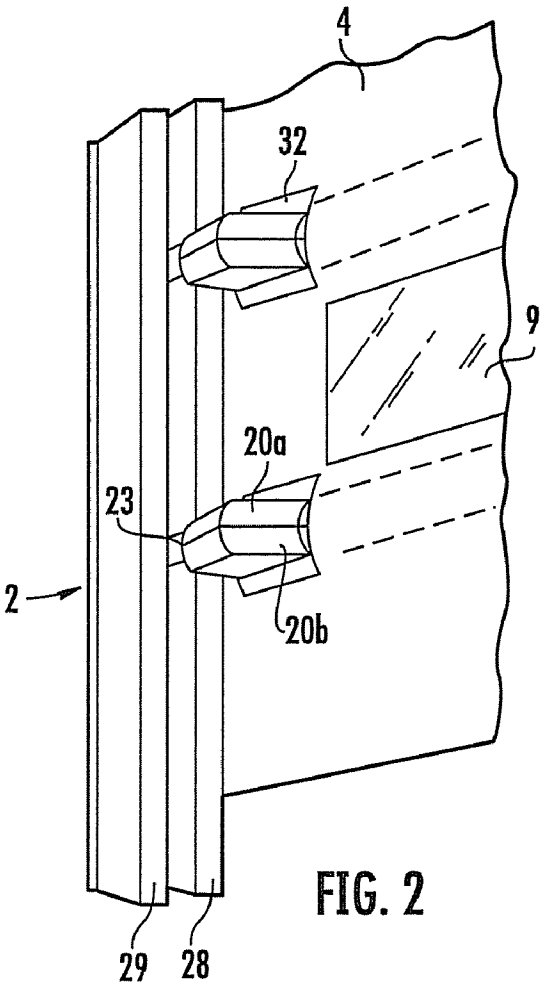
FIG. 2 represents in perspective, from the internal zone delimited by the door, two guide devices engaged in a slide.
Figure 3:
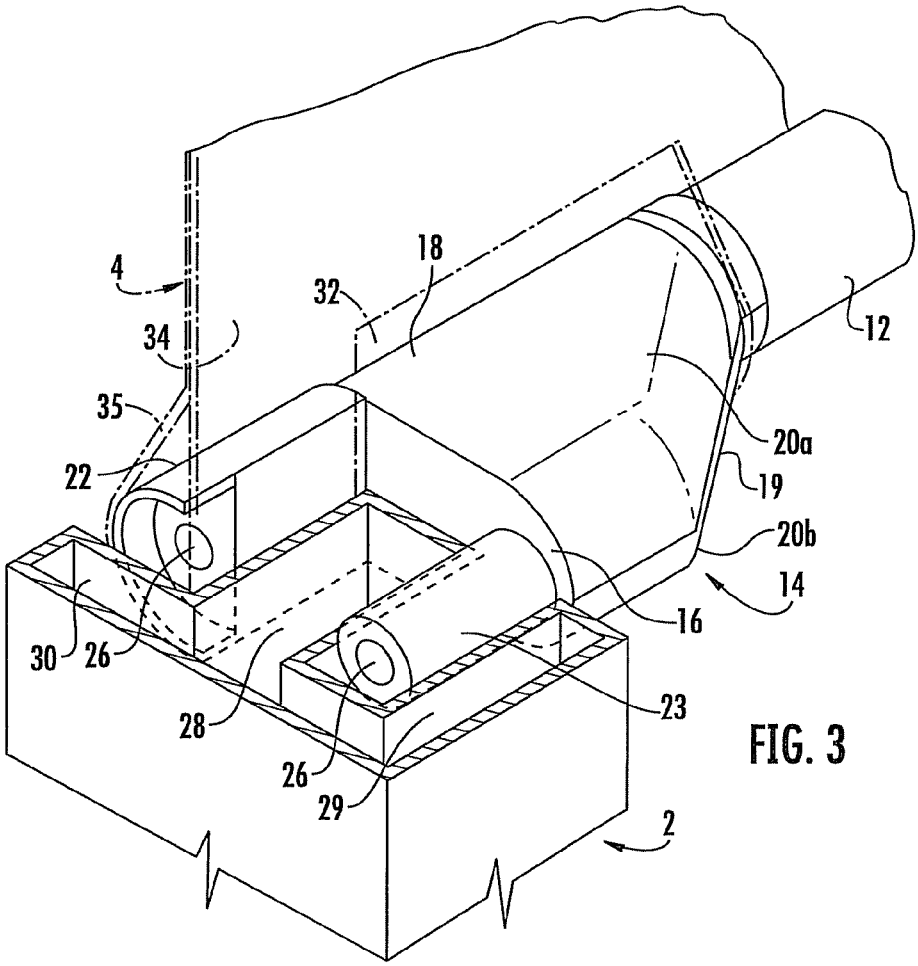
FIG. 3 represents in perspective and in section the guide device engaged in a slide.

With reference to FIG. 2 or FIG. 3, it can be seen that a guide device 14 is disposed in the extension of each of the stiffening bars.

The guide device 14 comprises a body of substantially trapezoidal shape having a large base 16 and a small base 17 that are parallel, these two bases being connected first by a semicylindrical wall 18 perpendicular to the two bases and by an oblique semicylindrical wall.

It is also notable that the body of the guide device consists of two half-shells 20*a*, 20*b* molded in a material having a certain elasticity.

As clearly shown in FIG. 3, the large base of the body is fitted with a semicylindrical ring 22 and a rotary roller 23.

The semicylindrical ring 22 and the roller 23 are mounted on two shafts 25, 26 sandwiched between the two half-shells 20*a*, 20*b*. An important feature, as will be seen hereinafter, is that the semicylindrical ring 22 is situated in the extension of the semicylindrical wall 18 of the body.

At the small base 16, the body has a blind hole extended by a collar.

One element to be taken into consideration in the door according to the invention consists of the two lateral slides 2.

Figure 6:
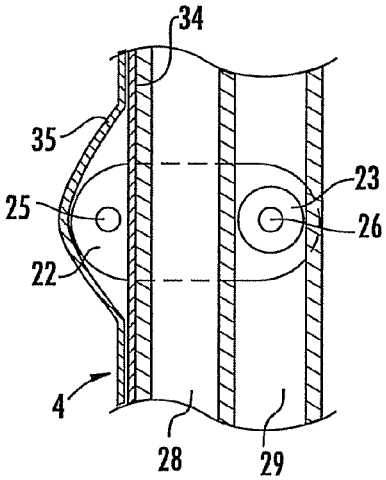
FIG. 6 represents section of the embodiment shown in FIG. 4.

As can be seen in cross section in FIG. 6, each of the slides has an external flange 28 and an internal flange 29, these two flanges being parallel.

Note also that the slide 2 has an extension 30 toward the outside, perpendicular to the external flange 28.

Another characteristic element of this door consists of the aperture 32 made in the shutter at the end of each stiffening bar.

Note that the shutter has a multilayer structure, especially at the stiffening bars 12. The latter are inserted into a sheath consisting of a strip 34 of flexible material welded onto a nut to form the sheath 35.

The door therefore operates as follows.

Figure 4:
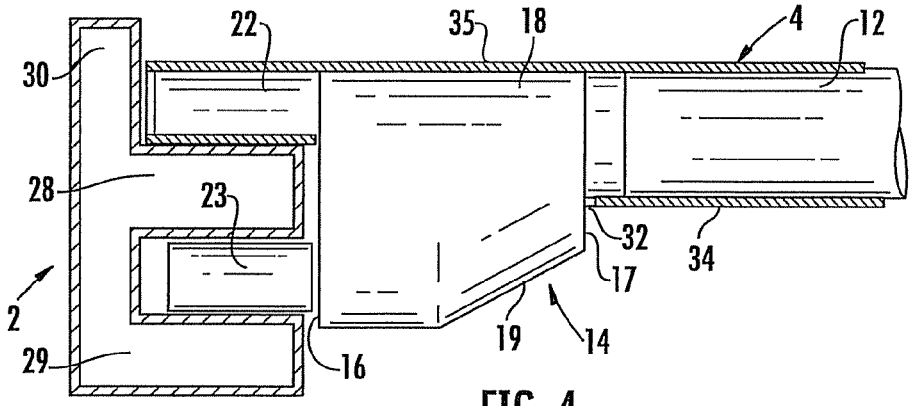
FIG. 4 is a view in cross section at the end of a stiffening bar.

As can be seen in FIG. 2 or in FIG. 3, the guide device 14 is jointed onto each end of the stiffening bars 12. The diameter of the blind hole relative to that of the stiffening bar is such that the guide device is free to rotate relative to the stiffening bar 12 translation of the guide device is locked by the aperture 32 since, at its oblique wall, the guide device protrudes beyond this window, but as can be seen in FIG. 4, is held in the axial direction of the stiffening bar 12 by the edges of the aperture 32. The guidance of the shutter is then provided by the semicylindrical ring 22 whose flat wall is pressing against the external face of the flange 28 and whose roller 23 is bounded by the face of the external flange and by the external face of the flange 29.

Figure 5:
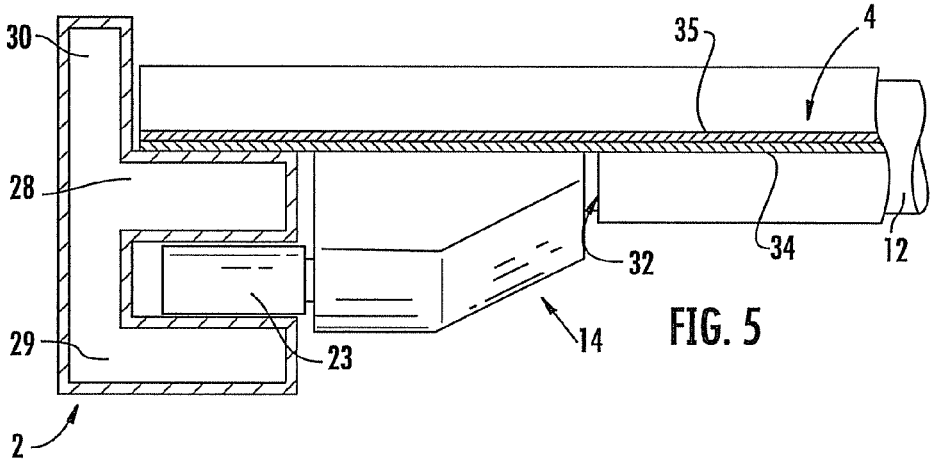
FIG. 5 is a view also in perspective of the embodiment shown in FIG. 2.

This guide device allows the shutter to be perfectly guided relative to the slides 2 and that, as shown in FIG. 5, which shows a cross section of the door between two stiffening bars 12, the shutter 4 is pressed against the external face of the external flange.

This feature is particularly advantageous when the wind blows since the action of the wind then tends to flatten the lateral edges of the shutter 4 against each of the flanges 28 with which slides are provided.

It should also be noted that, when the wind blows in a transverse direction, that is to say parallel to the plane of the shutter 4, the extension 30 with which the slides are fitted protects against the ingress of a lateral air current.

If the shutter is raised, the guide device 14 therefore slides relative to the slides 2. A point that is important to note is that the formation of folds in the top part of the door occurs harmoniously partly because the guide devices 14 can pivot relative to the stiffening bars and partly because the semicylindrical rings 22 situated in the extension of the body form with the stiffening bars 12 a semicylindrical element across the whole width of the shutter.

Finally, it should be noted that the door thus defined has a remarkable behavior relative to impacts that it may sustain.

It should specifically be noted that, when the door is acted upon accidentally from the exterior, it offers a possibility of disengaging the end pieces of the slides without irreversible damage to the shutter 4. Specifically, during an accidental action against the shutter 4, the stiffening bar 12 flexes and the guide devices disengage from the slides. This disengagement may occur in two ways. Either the flexing of the bar causes the roller 23 and the semispherical ring 22 to disengage from each of the flanges 28, 29; note in passing that the reaction of two bearing surfaces must be overcome since the semispherical ring 22 is pressing against the external flange 28 and the roller 23 is pressing against the internal flange 29. Or in a second mode of disengagement of the guide device, the disengagement is obtained by the two half-shells 20*a*, 20*b* opening relative to one another since, as has been seen, the latter are made of an elastic material. Thus, the end of the stiffening bar may escape from the device by the opening of these two half-shells 20*a*, 20*b* due to their elastic deformation.

During an accidental impact from the interior, the same method of disengagement occurs, since, in this case, only the roller 23 is pressing against the external flange 28.

Figure 7:
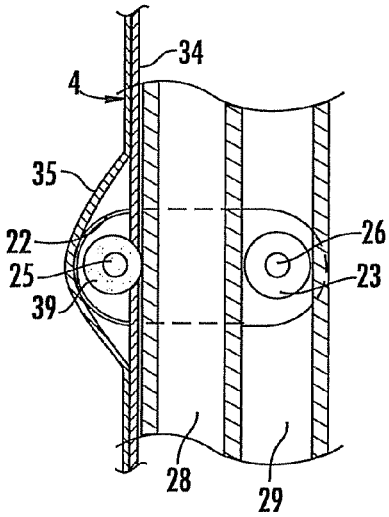
FIG. 7 represents a variant embodiment of the guide device.

FIG. 7 represents a variant embodiment in which a roller 39 is inserted into the semicylindrical ring. This roller 39 protrudes beyond the shutter 4 via an aperture made in the latter which allows this roller 39 to be in contact with the external flange 29. This variant embodiment makes it possible to preserve the integrity of the shutter 4 at its zone of friction against the external flange 28.

Figure 8:
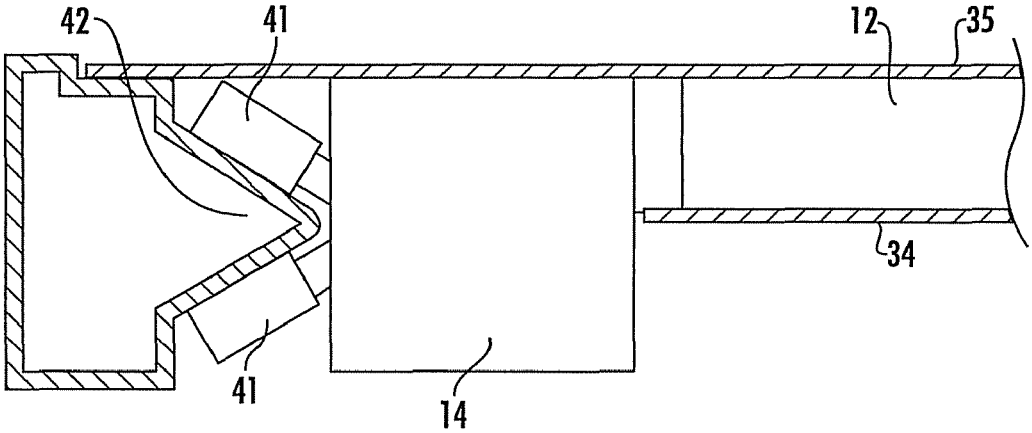
FIG. 8 represents in section another possible embodiment of the guide device.

FIG. 8 represents another possible embodiment in which the guide members consist of two rollers 41 oriented in a V-formation one relative to the other, capable of pressing against a rib 42 having a V-section.

Figure 9:
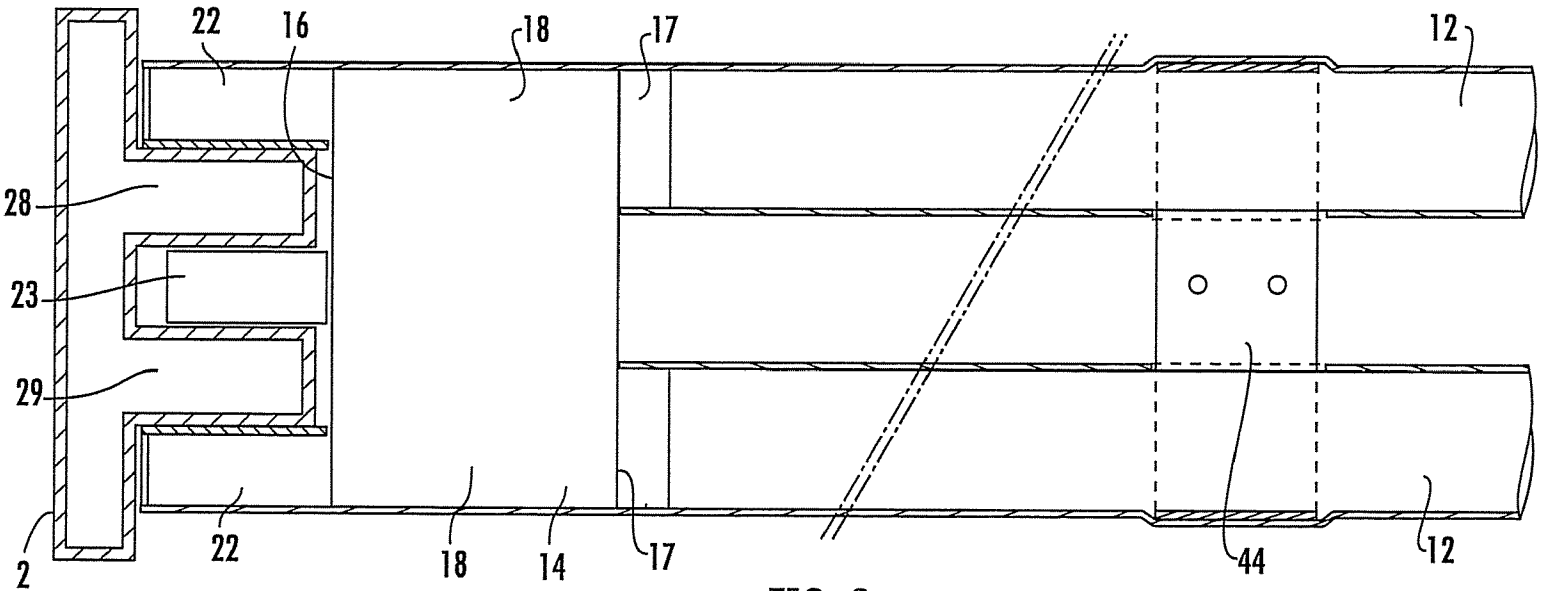
FIG. 9 represents in section a door having two parallel shutters.

FIG. 9 represents a door having two shutters. According to this embodiment, the latter comprises a guide device that can engage with a stiffener belonging to each of the shutters, having a guide member offset relative to the plane of each of the shutters. The guide device comprises two semicylindrical rings 22 enclosing a roller 23.

In this possible embodiment, a link strut 44 connects two stiffening bars 12 which makes it possible to create an assembly a high inertia whilst having a limited mass.

The door thus described therefore has many advantages since it ensures a lateral guidance of its shutter and a very high degree of lateral seal.

The invention has been described hereinabove with reference to a nonlimiting exemplary embodiment but it of course embraces all the embodiments. Thus the slides appear to be in two parts, the extension 30 being formed by a fitted cover.

The invention claimed is:

1. A door comprising two vertical slides and two parallel flexible shutters capable of being folded in an upper part of the slides, having at least one transverse stiffening bar, a guide device engaged in an extension of the at least one stiffening bar producing a guide of the two parallel flexible shutters in at least one of the slides in a plane offset relative to a plane of at least one of the two parallel flexible shutters, wherein the two parallel flexible shutters press against and overlap an outer face of a flange extending from each of the slides, the outer face running substantially parallel to a lateral surface of each of the shutters, and wherein the guide device can engage with a stiffener included with each of the shutters, having at least one guide member offset relative to the plane of each of the flexible shutters.

2. The door as claimed in claim 1, wherein the guide device has at least one guide member whose axis is offset relative to the plane of the shutter.

3. The door as claimed in claim 1, wherein the connection between the guide device and the stiffening bar allows the guide device to rotate relative to the stiffening bar.

4. The door as claimed in claim 1, wherein at least one of the connections between the guide device and the stiffening bar and the guide device and the slide is capable of dislocating under an external action exceeding a predetermined value.

5. The door as claimed in claim 1, wherein the guide device has at least one breakaway or deformation zone configured to allow disengagement of the guide device from the stiffening bar or from the slide.

6. The door as claimed in claim 1, wherein at least one link strut connects two stiffening bars.

7. The door as claimed in claim 1, wherein each of the slides has a second flange delimiting with the first flange a groove receiving a guide member of the guide device.

8. The door as claimed in claim 1, wherein the shutter has an aperture at an end of each stiffening bar through which the guide device protrudes.

9. A guide device for a door as claimed in claim 1, the guide device comprising a body having at a first end, at least one means of engagement with a stiffening bar, and, at a second end, at least one guide member whose axis is offset relative to an axis of means of engagement with the stiffening bar.

10. The device as claimed in claim 9, the body having a large base and a small base that are parallel and connected by a semi-cylindrical wall perpendicular to the two bases, the large base being fitted with at least one guide member and the small base having a blind hole capable of receiving a stiffening bar.

11. The device as claimed in claim 10, wherein the guide members comprise:

a ring having a semi-cylindrical wall placed in an extension of the semi-cylindrical wall and a flat wall, and a rotary roller.

12. The device as claimed in claim 11, wherein the semi-cylindrical wall encloses a roller.

13. The device as claimed in claim 12, wherein the guide members comprise two rollers oriented in a V-formation one relative to the other, capable of pressing against a rib having a V-section.

14. The device as claimed in claim 9, the body having a large base and two small bases symmetrical relative to a mid-plane, each of the bases being connected to the large base by a first semi-cylindrical wall, the large base being fitted with at least one guide member and each of the small bases having a blind hole capable of receiving a stiffening bar.

15. The device as claimed in claim 14, wherein the guide members comprise:

a rotary roller, and two rings symmetrical relative to the rotary roller having a second semi-cylindrical wall placed in an extension of the first semi-cylindrical wall and a flat wall.

16. A guide device for a door as claimed in claim 1, wherein the lateral surface of the shutter extends from one of the two vertical slides to the other of the two vertical slides.

* * * * *